US012144444B2

(12) United States Patent
Avellanet

(10) Patent No.: US 12,144,444 B2
(45) Date of Patent: Nov. 19, 2024

(54) MOBILE BEVERAGE HOLDER ASSEMBLY

(71) Applicant: Blue Box Ventures LLC, Miami Lakes, FL (US)

(72) Inventor: Alejandra Avellanet, Miami Lakes, FL (US)

(73) Assignee: Blue Box Ventures LLC, Miami, FL (US)

( * ) Notice: Subject to any disclaimer, the term of this patent is extended or adjusted under 35 U.S.C. 154(b) by 529 days.

(21) Appl. No.: 16/751,939

(22) Filed: Jan. 24, 2020

(65) Prior Publication Data

US 2022/0175166 A1 Jun. 9, 2022

Related U.S. Application Data

(60) Provisional application No. 62/797,642, filed on Jan. 28, 2019.

(51) Int. Cl.
*A47G 23/02* (2006.01)
*A45C 13/00* (2006.01)
*A45F 5/00* (2006.01)

(52) U.S. Cl.
CPC ..... *A47G 23/02* (2013.01); *A45C 13/001* (2013.01); *A45F 5/00* (2013.01); *A45C 2200/20* (2013.01)

(58) Field of Classification Search
CPC .. A47G 23/02; A45C 13/001; A45C 2200/20; A45F 5/00
USPC ..... 248/311.2
See application file for complete search history.

(56) References Cited

U.S. PATENT DOCUMENTS 3,643,606 A * 2/1972 Vise ..... B60N 3/005 108/44
4,560,128 A 11/1985 Willeby et al.
4,915,035 A * 4/1990 Clark ..... B60N 3/005 108/44
5,285,940 A * 2/1994 Goulter ..... A45F 5/00 108/43
5,845,585 A * 12/1998 Meeus ..... B60N 3/005 108/165
D417,763 S 12/1999 Monem
6,036,158 A * 3/2000 Raasch ..... B60N 3/005 108/44
6,076,876 A 6/2000 Letourneau et al.
6,390,431 B1 5/2002 Ott
(Continued)

FOREIGN PATENT DOCUMENTS

CN 205233743 U * 5/2016

*Primary Examiner* — Kimberly T Wood
(74) *Attorney, Agent, or Firm* — Mark C. Johnson; Johnson Dalal

(57) ABSTRACT

A mobile beverage holder assembly is structured for use with a piece of luggage and/or a seat back pocket to support at least one beverage container in an upright position. A mobile beverage holder assembly includes a mounting unit having a mounting member with a mounting aperture formed there through, wherein the mounting aperture is dimensioned for mounting over a handle of the piece of luggage. The mobile beverage holder assembly also includes a beverage holder unit directly interconnected to the mounting unit. The beverage holder unit comprises one or more beverage holders, each of which are dimensioned to receive and support at least one beverage container in an upright, operative orientation.

9 Claims, 10 Drawing Sheets

(56) References Cited

U.S. PATENT DOCUMENTS 6,409,137 B1 * 6/2002 Tran ..... A47C 7/68 206/549
6,749,204 B2 7/2004 Werner
7,364,129 B1 * 4/2008 Levari, Jr. ..... A45C 13/00 108/4
7,472,791 B2 * 1/2009 Spivey, Sr. ..... B65D 71/36 206/427
7,510,157 B2 * 3/2009 Oliver ..... A45C 13/28 220/739
7,690,502 B2 * 4/2010 Cuomo ..... B65D 71/0022 206/168
7,950,335 B1 * 5/2011 Almond ..... F16M 11/32 108/42
D650,639 S 12/2011 Freese et al.
8,235,190 B2 8/2012 Porte et al.
8,485,327 B1 6/2013 Dalrymple
8,955,656 B1 * 2/2015 Foster ..... A45C 5/03 108/17
9,114,734 B2 8/2015 Hackney
9,434,287 B2 * 9/2016 Liebowitz ..... B60N 3/103
D777,441 S 1/2017 Li
D777,528 S 1/2017 Landphere
9,578,939 B2 2/2017 Nebeling
9,615,540 B1 * 4/2017 Mansour ..... A01K 5/0135
9,809,440 B2 * 11/2017 Kellerman ..... B67D 1/16
10,034,537 B2 * 7/2018 Long, Jr. ..... A45C 13/28
10,137,814 B2 * 11/2018 Liebowitz ..... B60N 3/103
10,582,789 B2 3/2020 Klugh et al.
10,959,557 B1 11/2021 Nazarian
D940,520 S 1/2022 Avellanet
2003/0000429 A1 * 1/2003 Ryburg ..... A47B 23/04 108/42
2004/0021353 A1 * 2/2004 Lozano ..... A47D 1/10 297/255
2006/0022006 A1 * 2/2006 Cruise ..... A45C 13/28 224/572
2006/0037825 A1 2/2006 Dayton et al.
2006/0219745 A1 * 10/2006 Riley ..... A47G 23/0225 224/400
2006/0243768 A1 * 11/2006 Dowell ..... B60R 11/00 224/400
2007/0007425 A1 1/2007 Perotti
2008/0116342 A1 * 5/2008 Oliver ..... A45C 13/28 248/311.2
2010/0051633 A1 * 3/2010 Porte ..... A45C 13/28 220/737
2011/0139948 A1 6/2011 Bergin
2012/0067683 A1 * 3/2012 Cummins ..... A47C 7/622 190/115
2013/0075351 A1 3/2013 Lueker
2013/0126540 A1 * 5/2013 Vesterby ..... A45C 13/28 220/737
2013/0126686 A1 * 5/2013 Ballou ..... A47G 23/0225 248/205.2
2014/0110202 A1 * 4/2014 Vesterby ..... A45C 13/30 190/103
2014/0299428 A1 10/2014 Gadbois
2016/0022032 A1 * 1/2016 Simon ..... A45C 13/28 108/42
2016/0037905 A1 * 2/2016 Glover ..... A45C 13/28 108/42
2016/0045022 A1 * 2/2016 Shannon ..... A47B 3/10 108/28
2016/0081505 A1 * 3/2016 Berg ..... A45C 13/28 224/401
2016/0227949 A1 * 8/2016 Klugh ..... A45C 13/28
2017/0325559 A1 * 11/2017 Johnson ..... A47G 23/0216
2017/0325560 A1 * 11/2017 Williams ..... A47B 3/10
2018/0023887 A1 1/2018 Oh
2018/0092481 A1 * 4/2018 Berg ..... A45C 13/262
2018/0271310 A1 * 9/2018 Klugh ..... A45C 13/28
2021/0100385 A1 4/2021 Delaney
2021/0282520 A1 * 9/2021 Weng ..... A45C 13/262
2021/0345746 A1 * 11/2021 Hamaty ..... A45C 5/14

* cited by examiner

MOBILE BEVERAGE HOLDER ASSEMBLY

BACKGROUND OF THE INVENTION

Field of the Invention

The present invention is directed to a mobile beverage holder assembly for use with a piece of luggage or a seat back pocket, the mobile beverage holder assembly having a beverage holder unit to support at least one beverage container therein.

Description of the Related Art

Today's society is becoming increasingly mobile, with more and more people traveling daily via commercial aircraft, subway, commuter train, etc. Furthermore, today's commuters are often found traveling with some form of roll-aboard luggage or baggage, whether it be a standard piece of luggage, a mobile file case, etc.

Today's commuters are often likely to consume food and beverages while walking or waiting in an airline terminal, subway station, commuter train station, etc. A common problem which may be witnessed on a daily basis in airline terminals, subway stations, commuter train stations, etc., is that people have nowhere convenient to place a beverage they are consuming while walking through or waiting in any of these facilities. While disposable food and beverage carriers are often provided by the food and beverage vendors in such facilities, these carriers are simply not configured properly to be stably positioned on the roll-aboard luggage or baggage accompanying most commuters today.

Thus, it would be beneficial to provide an assembly to hold one or more beverage containers in an upright and operative position which may be easily yet removably mounted to a piece of roll-aboard luggage or baggage. A further advantage may be realized by such an assembly if it were configured such that it could also easily yet removably be mounted into a seat back pocket such as are typically found in commercial aircraft, commuter trains, etc. Yet another benefit may be achieved if such an assembly were manufactured of lightweight and low cost recyclable materials so as to minimize the cost of production, transport, and disposal thereof.

SUMMARY OF THE INVENTION

The present invention is directed to a mobile beverage holder assembly for use with a piece of luggage or a seat back pocket to support at least one beverage container therein. In at least one embodiment, a mobile beverage holder assembly comprises a mounting unit comprising a mounting member with a mounting aperture formed there through, wherein the mounting aperture is dimensioned for positioning over a handle of the piece of luggage. In at least one further embodiment, a mounting member includes one or more adjustment tabs removable disposed at either end of the mounting aperture, wherein the adjustment tabs may be removed to facilitate mounting the mobile beverage holder assembly to a piece of luggage having a wider handle.

A mobile beverage holder assembly in accordance with at least one embodiment of the present invention may further comprise a suspension unit interconnected to the mounting unit via a mounting unit interface. In at least one embodiment, the mounting unit interface comprises a living hinge and permits positioning of the suspension unit approximately 90 degrees relative to the mounting unit.

The mobile beverage holder assembly of the present invention further comprises a beverage holder unit. In one embodiment, the beverage holder unit is interconnected to a suspension unit. In at least one further embodiment of the present invention, the beverage holder unit is interconnected directly to the mounting unit. The beverage holder unit includes at least one beverage holder which is structured and dimensioned to receive and support at least one beverage container in an upright, operative orientation therein. In one further embodiment, a beverage holder unit comprises a plurality of beverage holders, each of the beverage holders structured and dimensioned to receive and support at least one beverage container in an upright, operative orientation therein.

These and other objects, features and advantages of the present invention will become clearer when the drawings as well as the detailed description are taken into consideration.

BRIEF DESCRIPTION OF THE DRAWINGS

For a fuller understanding of the nature of the present invention, reference should be had to the following detailed description taken in connection with the accompanying drawings in which.

Like reference numerals refer to like parts throughout the several views of the drawings.

DETAILED DESCRIPTION

The present invention is directed to a mobile beverage holder assembly, generally as shown as at 10 throughout FIGS. 1 through 6. More in particular, the present invention is directed to a mobile beverage holder assembly 10 for use in conjunction with a piece of luggage to support at least one beverage container thereon, such as is shown in the illustrative embodiment of FIGS. 5 and 6. Additionally, in at least one embodiment, the present invention is directed to a mobile beverage holder assembly 10 for use in conjunction with a seat back pocket, once again, to support at least one beverage container thereon.

Figure 1:
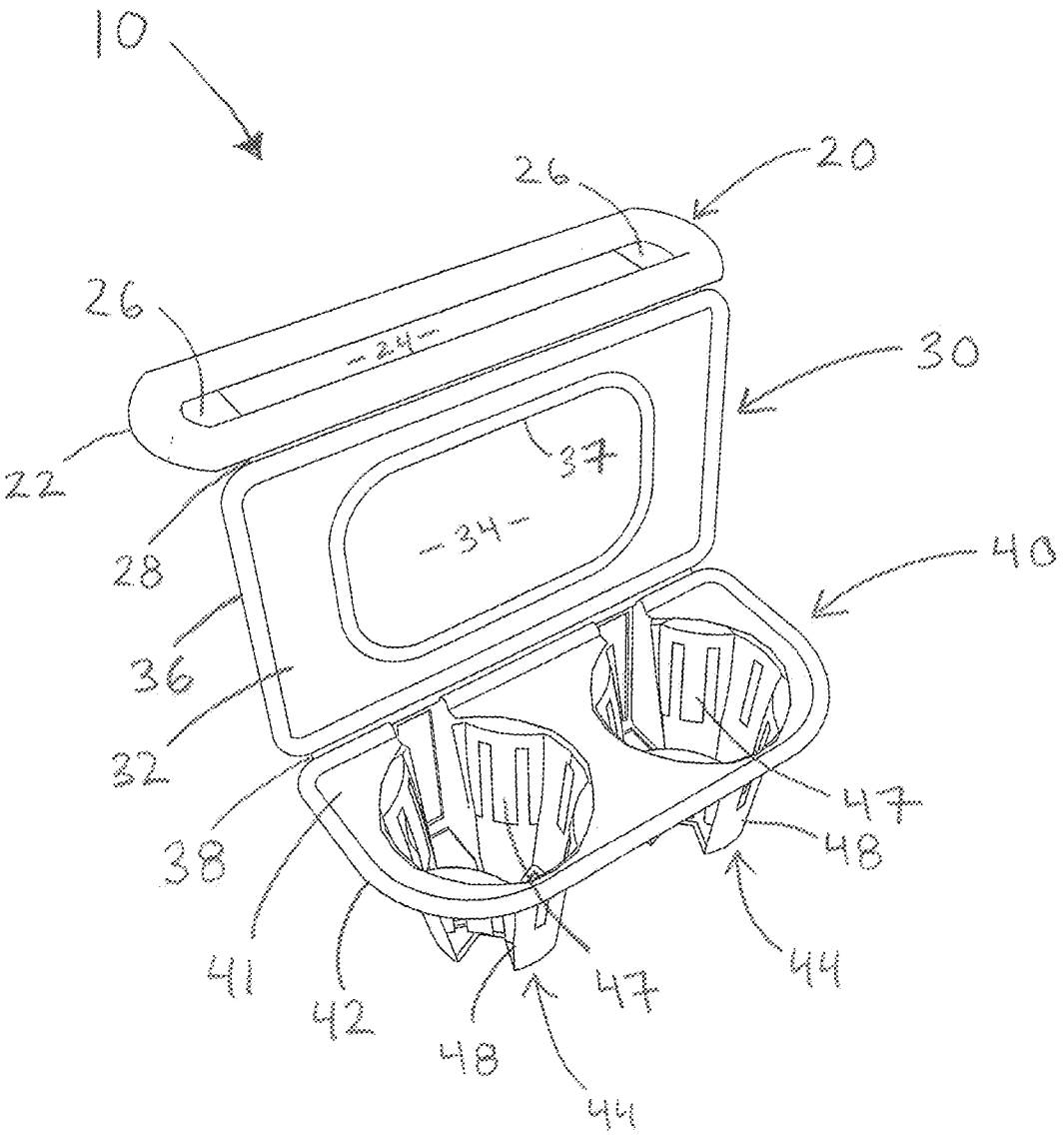
FIG. 1 is a perspective view of one illustrative embodiment of a mobile beverage holder assembly in accordance with the present invention.

With reference to the illustrative embodiment of FIG. 1, a mobile beverage holder assembly 10 in accordance with the present invention includes a mounting unit 20. As further shown in the illustrative embodiment of FIG. 1, the mobile beverage holder assembly 10 further comprises a suspension unit 30. In at least one embodiment, a suspension unit 30 is interconnected to a mounting unit 20. With further reference to the illustrative embodiment of FIG. 1, a mobile beverage holder assembly 10 in accordance with the present invention further comprises a beverage holder unit 40. In accordance with at least one further embodiment of the present invention, a beverage holder unit 40 is interconnected to a suspension unit 30.

With continued reference to the illustrative embodiment of FIG. 1, a mounting unit 20 in accordance with the present invention comprises a mounting member 22 having a mounting aperture 24 formed there through. More in particular, a mounting member 22 comprises a mounting aperture 24 formed there through wherein the mounting aperture 24 has a length and width dimensioned for mounting over a handle of a piece of luggage, such as is shown in the illustrative embodiments of FIGS. 5 and 6. A mounting member 22 in accordance with at least one embodiment of the present invention comprises a geometric configuration so as to provide structural support to the mounting unit 20. It will be appreciated by those of skill in the art that the geometric configuration may comprise any of a number of geometric configurations including, but not limited to square, rectangular, curvilinear, triangular, trapezoidal, polygonal, etc. In at least one embodiment, a mounting member 22 in accordance with the present invention comprises a geometric configuration having a curvilinear configuration, such as is shown best in the illustrative embodiments of FIGS. 1 through 3.

In at least one embodiment, a mounting member 22 of a mounting unit 20 comprises at least one adjustment tab 26 disposed at one end of the mounting aperture 24. Adjustment tab 26 is removable from a mounting aperture 24 to increase an overall length of the mounting aperture 24, so as to accommodate a piece of luggage having a wider handle. In one further embodiment, such as is shown in the illustrative embodiment of FIG. 1, a mounting member 22 comprises a plurality of adjustment tabs 26 wherein each adjustment tab 26 is disposed at an opposite end of a mounting aperture 24. As before, each adjustment tab 26 is removable from a mounting aperture 24 to increase an overall length of the mounting aperture 24, so as to accommodate a piece of luggage having a longer handle.

As stated above, in at least one embodiment, a mobile beverage holder assembly 10 in accordance with the present invention includes a suspension unit 30 interconnected to a mounting unit 20. In at least one further embodiment, a suspension unit 30 is interconnected to a mounting unit 20 by a mounting unit interface 28. The mounting unit interface 28 allows the mounting unit 20 to be positioned at an approximately 90 degree angle relative to the suspension unit 30. As shown in the illustrative embodiment of FIG. 1, a mounting unit interface 28 extends substantially along the interface between a mounting unit 20 and a suspension unit 30. In at least one further embodiment, a mounting unit interface 28 comprises a living hinge disposed between and interconnecting a mounting unit 20 to a suspension unit 30.

Figure 2:
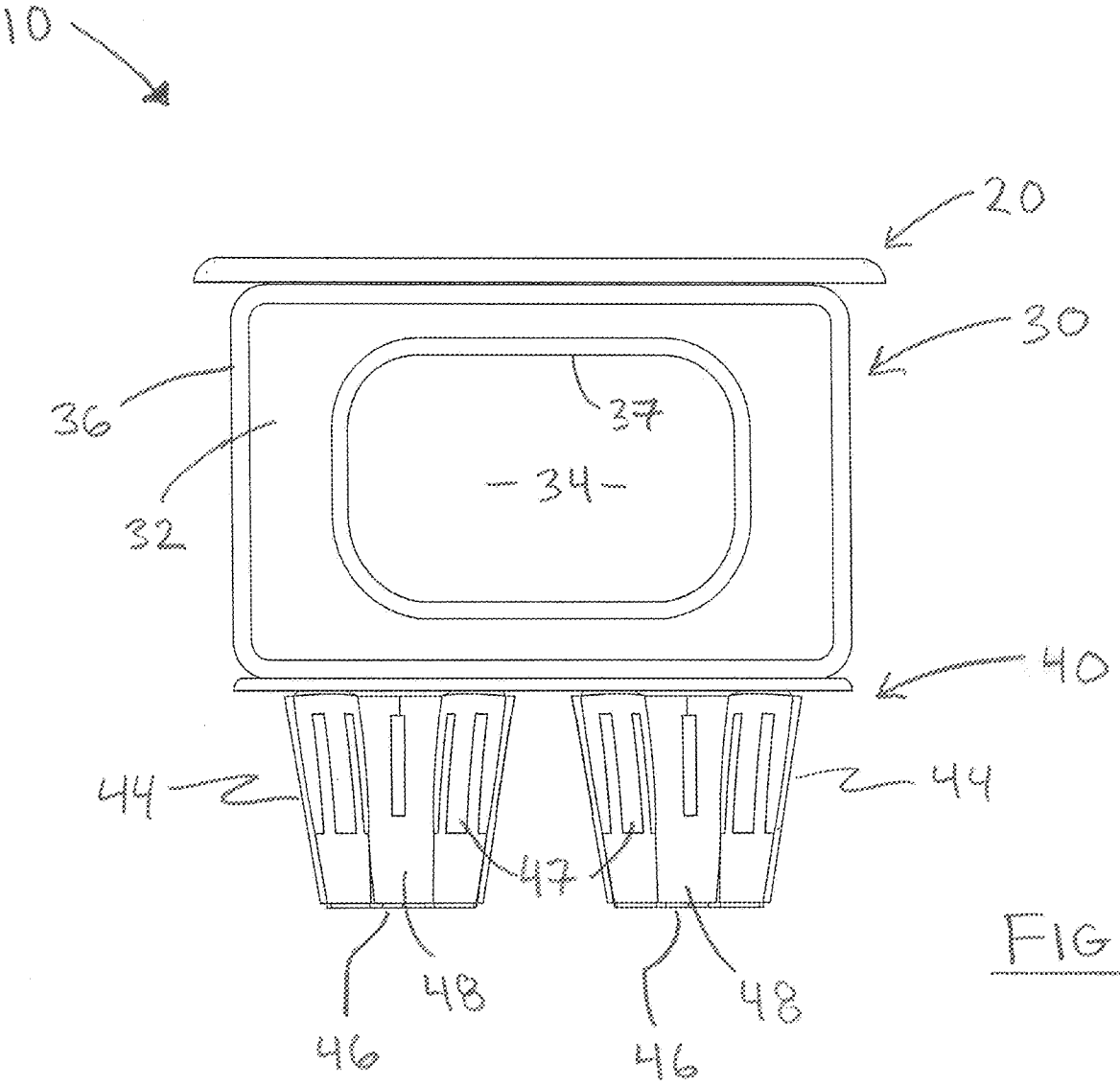
FIG. 2 is a front elevation of the mobile beverage holder assembly of the illustrative embodiment of FIG. 1.

As may be seen best in the illustrative embodiments of FIGS. 1 and 2, a suspension unit 30 comprises a suspension member 32. As further shown in the illustrative embodiments of FIGS. 1 through 6, a suspension member 32 of a suspension unit 30 is maintained in a generally vertical position while a mobile beverage holder assembly 10 in accordance with the present invention is disposed in an operative orientation relative to a piece of luggage. With continued reference to the illustrative embodiments of FIGS. 1 and 2, a suspension member 32 of the suspension unit 30 comprises a suspension aperture 34 formed there through. More in particular, a suspension member 32 in accordance with at least one embodiment of the present invention comprises a suspension aperture 34 formed there through so as to substantially reduce the amount of material required for construction of the suspension member 32.

In accordance with at least one embodiment of the present invention, a suspension member 32 comprises an outer periphery 36, as shown in the illustrative embodiments of FIGS. 1 and 2. As further shown in the illustrative embodiments of FIGS. 1 and 2, a suspension member 32 of the suspension unit 30 comprises an inner periphery 37 disposed substantially around a suspension aperture 34. An outer periphery 36 of a suspension member 32, in at least one embodiment, comprises a curvilinear configuration thereby providing additional structural support to the suspension member 32, such as is shown in the illustrative embodiments of FIGS. 1 through 6. In at least one further embodiment, an inner periphery 37 of a suspension member 32 also comprises a curvilinear configuration, once again, providing further structural support to the suspension member 32.

As also stated above, in at least one embodiment, a mobile beverage holder assembly 10 in accordance with the present invention includes a beverage holder unit 40 interconnected to a suspension unit 30. In at least one further embodiment, a beverage holder unit 40 is interconnected to a suspension unit 30 by a suspension unit interface 38. Similar to the mounting unit interface 28, a suspension unit interface 38 allows the beverage holder unit to be positioned at an approximately 90 degree angle relative to the suspension unit 30. As best shown in the illustrative embodiment of FIG. 1, a suspension unit interface 38 extends substantially along the interface between a beverage holder unit 40 and a suspension unit 30. In at least one further embodiment, a suspension unit interface 38 comprises a living hinge disposed between and interconnecting a beverage holder unit 40 to a suspension unit 30.

A beverage holder unit 40 in accordance with the present invention is dimensioned to receive and support at least one beverage container in an upright and operative orientation. More in particular, as discussed in greater detail below, a beverage holder unit 40 in accordance with at least one embodiment of the present invention comprises at least one beverage holder 44 which is dimensioned to receive at least a lower portion of a beverage container therein.

Turning once again to the illustrative embodiment of FIG. 1, a beverage holder unit 40 in accordance with the present invention comprises a platform member 41. In at least one embodiment, a platform member 41 of a beverage holder unit 40 is at least partially defined by an outer periphery 42. Similar to the mounting member 22 of the mounting unit 20 and the outer and inner peripheries 36, 37 of the suspension unit 30, in at least one embodiment, an outer periphery 42 of a beverage unit holder 40 comprises a geometric configuration so as to provide additional structural support to a platform member 41. As before, it will be appreciated by those of skill in the art that the geometric configuration may comprise any of a number of geometric configurations including, but not limited to square, rectangular, curvilinear, triangular, trapezoidal, polygonal, etc. In at least one embodiment, an outer periphery 42 of a beverage unit holder 40 in accordance with the present invention comprises a geometric configuration having a curvilinear configuration, such as is shown best in the illustrative embodiment of FIG. 1.

As stated above, a beverage holder unit 40 in accordance with the present invention comprises at least one beverage holder 44. Looking in particular to the illustrative embodiments of FIGS. 1 and 2, a beverage holder unit 40 in accordance with at least one embodiment of the present invention comprises a plurality of beverage holders 44.

A beverage holder 44 includes an access opening 45 through which a lower portion of a beverage container may be inserted into the beverage holder 44. With reference to the figures, a beverage holder 44 further comprises a base 46 disposed opposite an access opening 45. More particular, a base 46 of a beverage holder 44 is dimensioned and disposed to support a beverage container within a beverage holder 44. A beverage holder 44 in accordance with the present invention further comprises at least one sidewall 48 which interconnects a base 46 with a platform member 41 of a beverage holder unit 40. As shown throughout the figures, a beverage holder 44 in accordance with one further embodiment of the present invention includes a plurality of sidewalls 48 interconnecting the base 46 with a platform member 41 of the beverage holder unit 40.

A beverage holder 44 in accordance with the present invention further comprises at least one flexible flange 47 which is positioned within beverage holder 44 to operatively engage a lower portion of a beverage container so as to maintain and support a beverage container in upright and operative orientation within the beverage holder 44. With reference to the illustrative embodiments of FIGS. 1 through 4, each beverage holder 44 in accordance with the present invention comprises a plurality of flexible flanges 47, wherein each flexible flange 47 is positioned within the beverage holder 44 to operatively engage a lower portion of a beverage container so as to maintain and support a beverage container in upright and operative orientation within the beverage holder 44.

Figure 3:
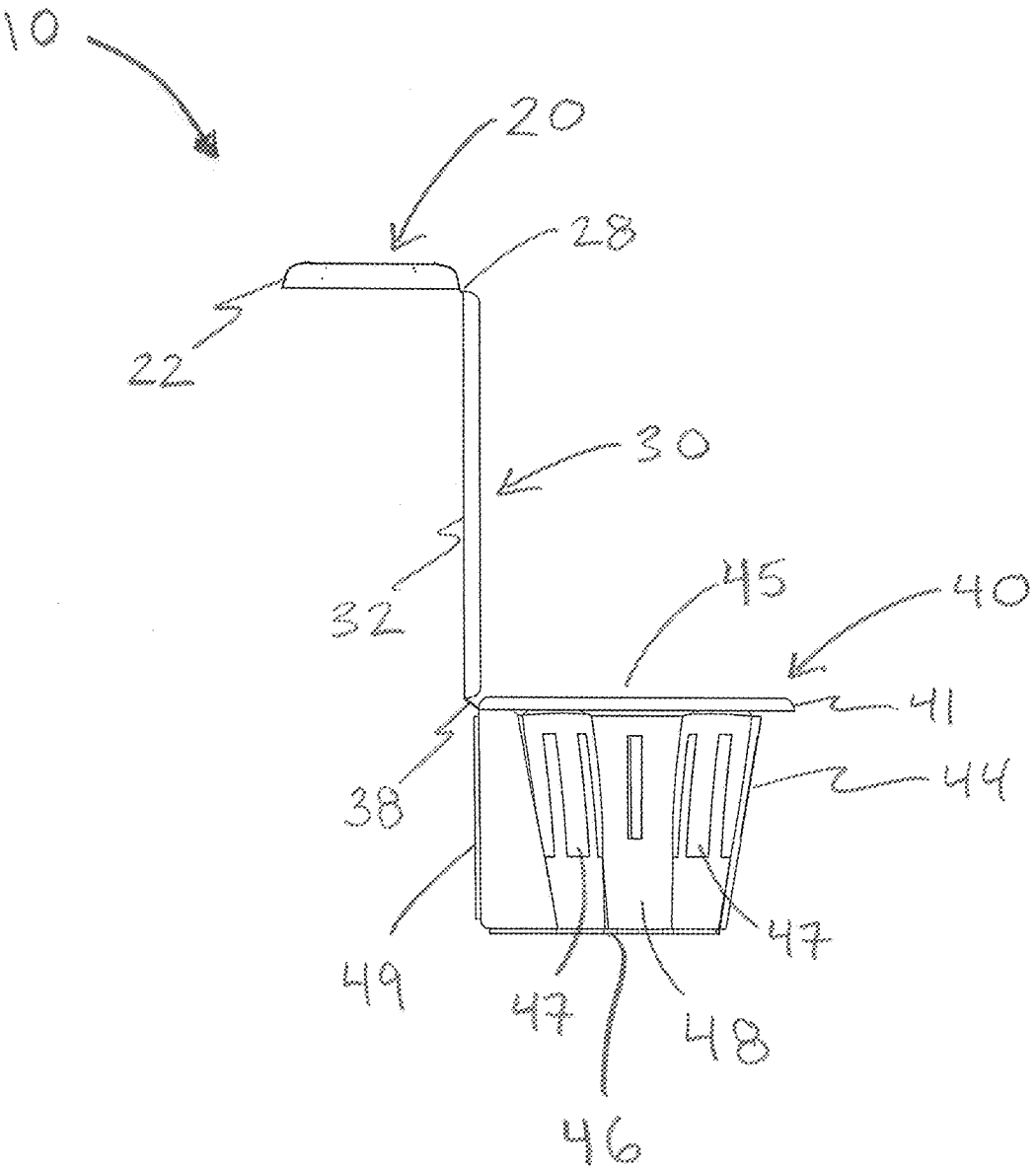
FIG. 3 is a side elevation of the mobile beverage holder assembly of the illustrative embodiment of FIG. 1.
Figure 4:
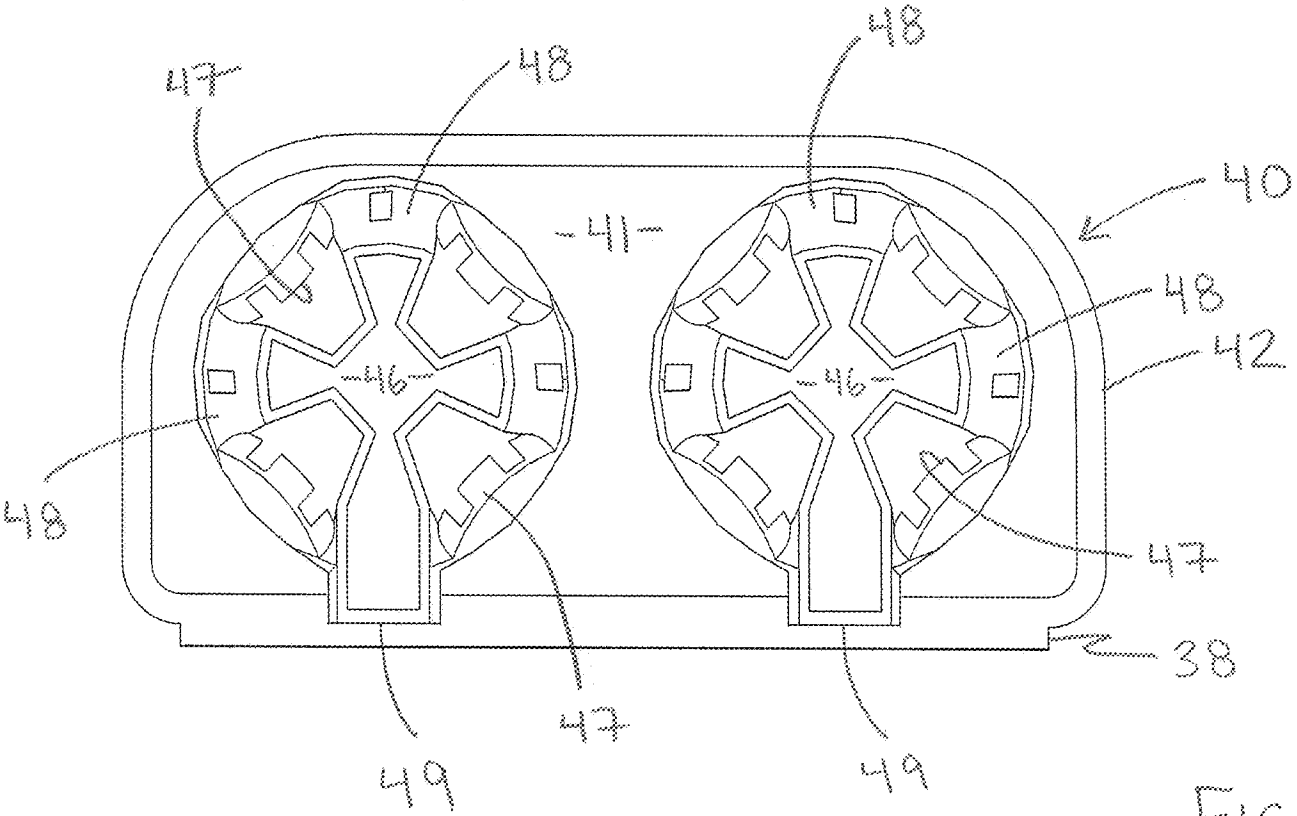
FIG. 4 is a bottom plan view of the mobile beverage holder assembly of the illustrative embodiment of FIG. 1.

Looking next with reference to the illustrative embodiments of FIGS. 3 and 4, a beverage holder 44 of a beverage holder unit 40 in accordance with the present invention comprises a support member 49. As shown best in the illustrative embodiment of FIG. 3, a support member 49 comprises a back wall which is disposed in vertical alignment with suspension member 32 when a mobile beverage holder assembly 10 in accordance with the present invention is disposed in an operative position on a piece of luggage. Therefore, a support member 49 serves to maintain a beverage holder 44 in a substantially upright orientation when a mobile beverage holder assembly 10 in accordance with the present invention is disposed in an operative position over a handle of a piece of luggage.

Figure 5:
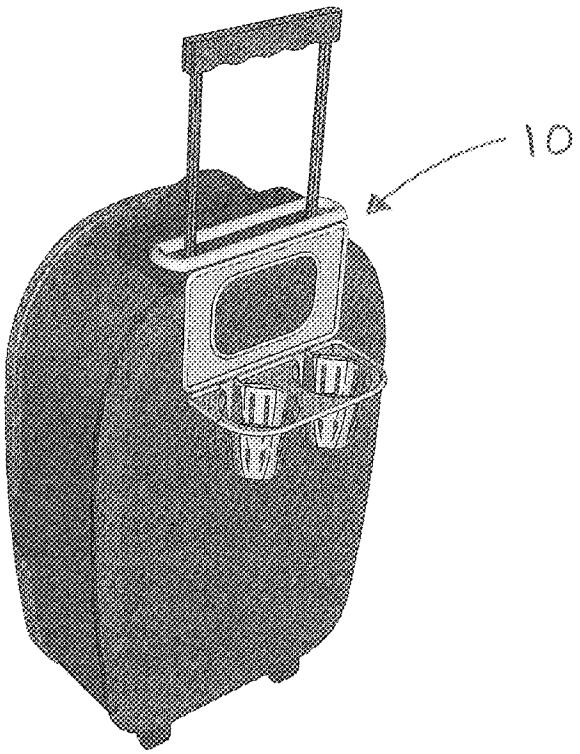
FIG. 5 is a perspective view of the mobile beverage holder assembly of the illustrative embodiment of FIG. 1 operatively mounted to a piece of luggage in accordance with the present invention.
Figure 6:
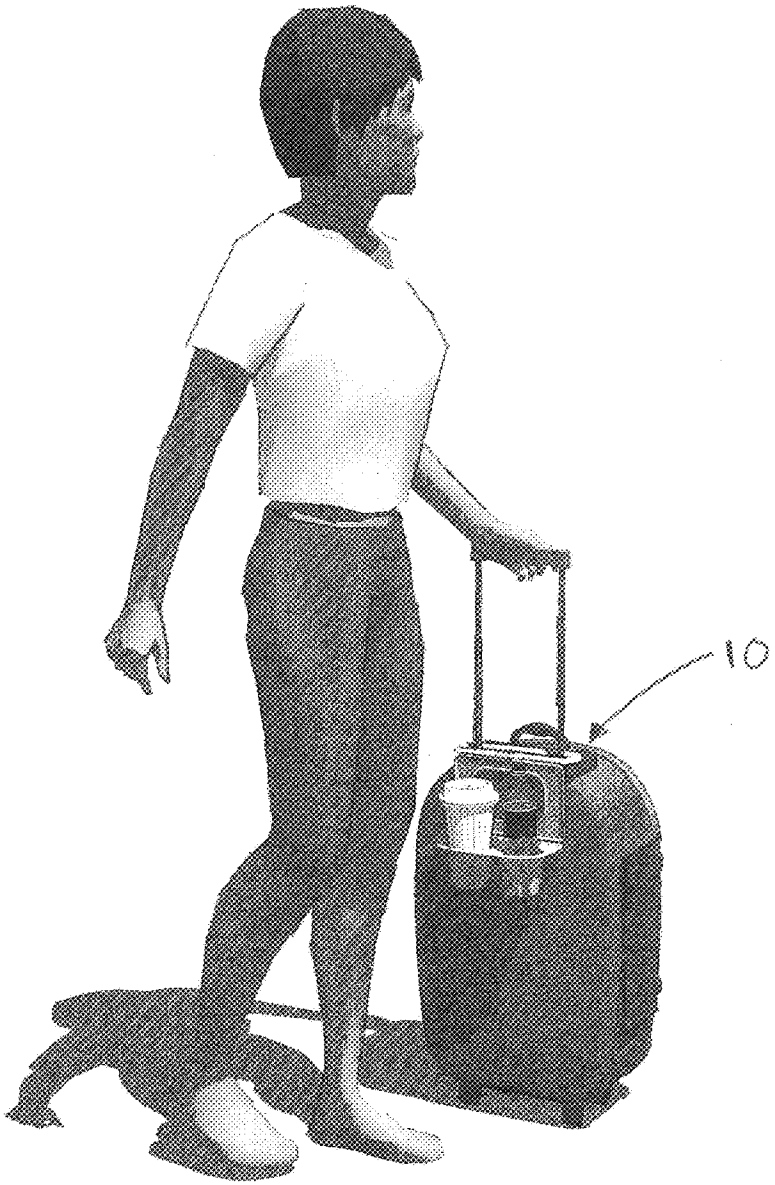
FIG. 6 is a perspective view of the mobile beverage holder assembly of the illustrative embodiment of FIG. 1 operatively mounted to a piece of luggage being moved by a person and having a plurality of beverages supported therein in accordance with the present invention.

More importantly, a support member 49 serves to maintain a beverage holder 44 in a substantially upright orientation such that the beverage holder 44 can receive and support a beverage container in an upright and operative orientation when a mobile beverage holder assembly 10 in accordance with the present invention is disposed in an operative position over a handle of a piece of luggage, such as is shown in the illustrative embodiments of FIGS. 5 and 6.

In accordance with at least one embodiment of the present invention, a mounting unit 20 and or suspension unit 30 of a mobile beverage holder assembly 10 are dimensioned to fit within a seat back pocket such as are commonly found in commercial airlines, commuter trains, automobiles, etc. As such, it will be appreciated by those of skill in the art that the present mobile beverage holder assembly 10 may be utilized to receive and support one or more beverage containers in upright and operative orientation while a user is traveling in a commercial airliner, commuter train, automobile, etc.

In one embodiment of the present invention, each of a mounting unit 20, a suspension unit 30 and a beverage holder unit 40 is independently formed and thereafter interconnected via a corresponding one of a mounting unit interface 28 and a suspension unit interface 38. Alternatively, one or more of a mounting unit 20, a suspension unit 30 and a beverage holder unit 40 may comprise a unitary construction. In yet one further embodiment, each of a mounting unit 20, a suspension unit 30 and a beverage holder unit 40 comprises a unitary construction.

As will further be appreciated by those of skill in the art a mobile beverage holder assembly 10 in accordance with the present invention may be constructed from any of a wide variety of materials including, but not limited to, cardboard, plastic, metal or metal alloys, fiberglass, etc. In one further embodiment, a mobile beverage holder assembly 10 in accordance with the present invention may be constructed from any of a variety of natural materials which are readily biodegradable including, but in no manner limited to, wheat straw, potato starch, corn starch, bagasse, bamboo and/or bamboo fibers, hemp and/or hemp fibers, etc. In at least one embodiment, a mobile average holder assembly 10 in accordance with the present invention may be constructed from any of a variety of recycled materials. In yet one further embodiment, a mobile beverage holder assembly 10 in accordance with the present invention is constructed of molded pulp, such as is commonly utilized in preparing disposable beverage and/or food carriers.

Turning next with reference to the alternative illustrative embodiment of FIGS. 7 through 10, a mobile beverage holder assembly 100 in accordance with the present invention once again includes a mounting unit 120. With further reference to the alternative illustrative embodiment of FIG. 7, a mobile beverage holder assembly 100 in accordance with the present invention further comprises a beverage holder unit 140. As may be seen best from the alternative illustrative embodiment of FIG. 7, the beverage holder unit 140 is directly interconnected to the mounting unit 120 of the present beverage holder assembly 100.

Figure 7:
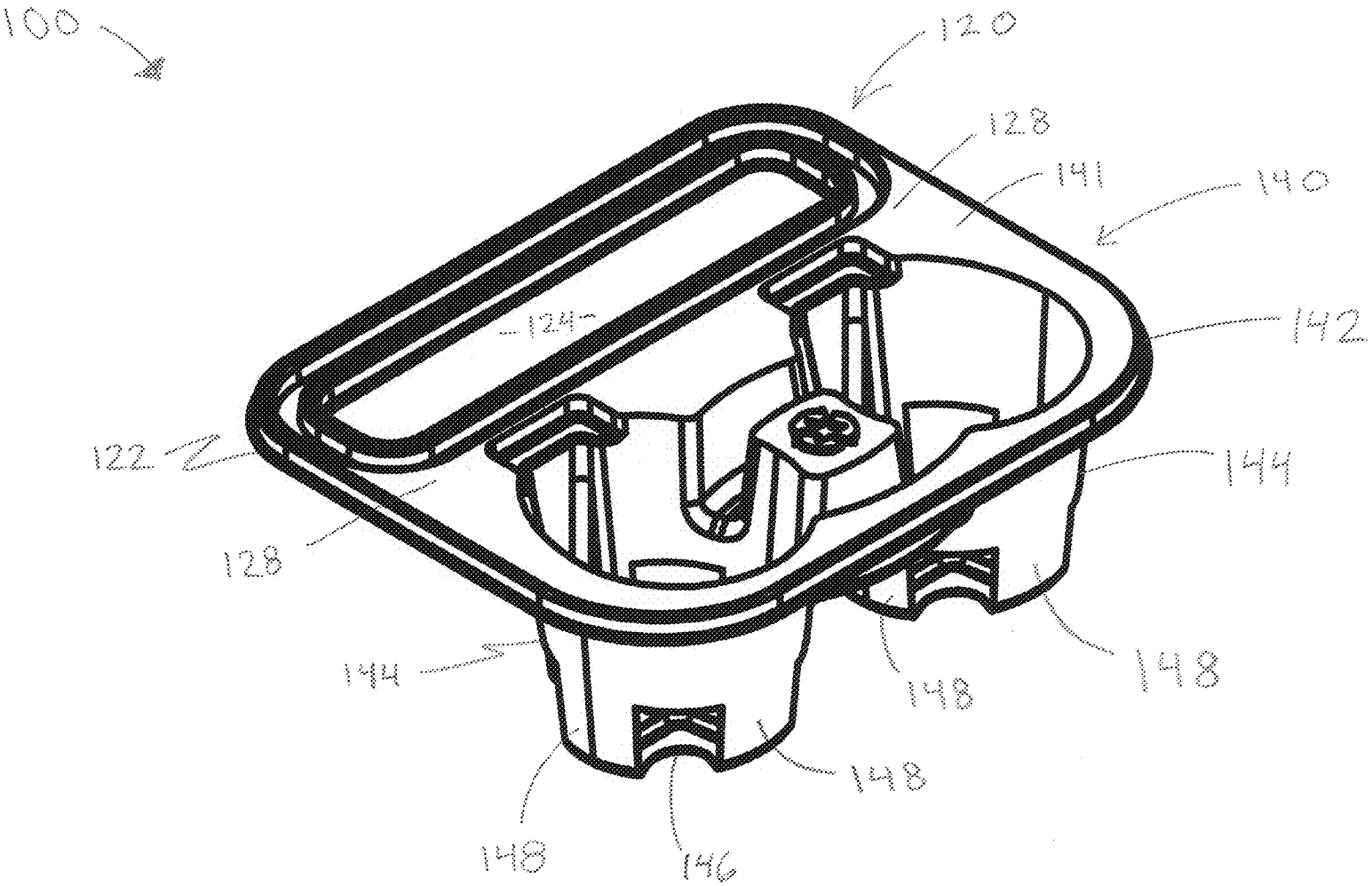
FIG. 7 is a perspective view of one alternative illustrative embodiment of a mobile beverage holder assembly in accordance with the present invention.
Figure 8:
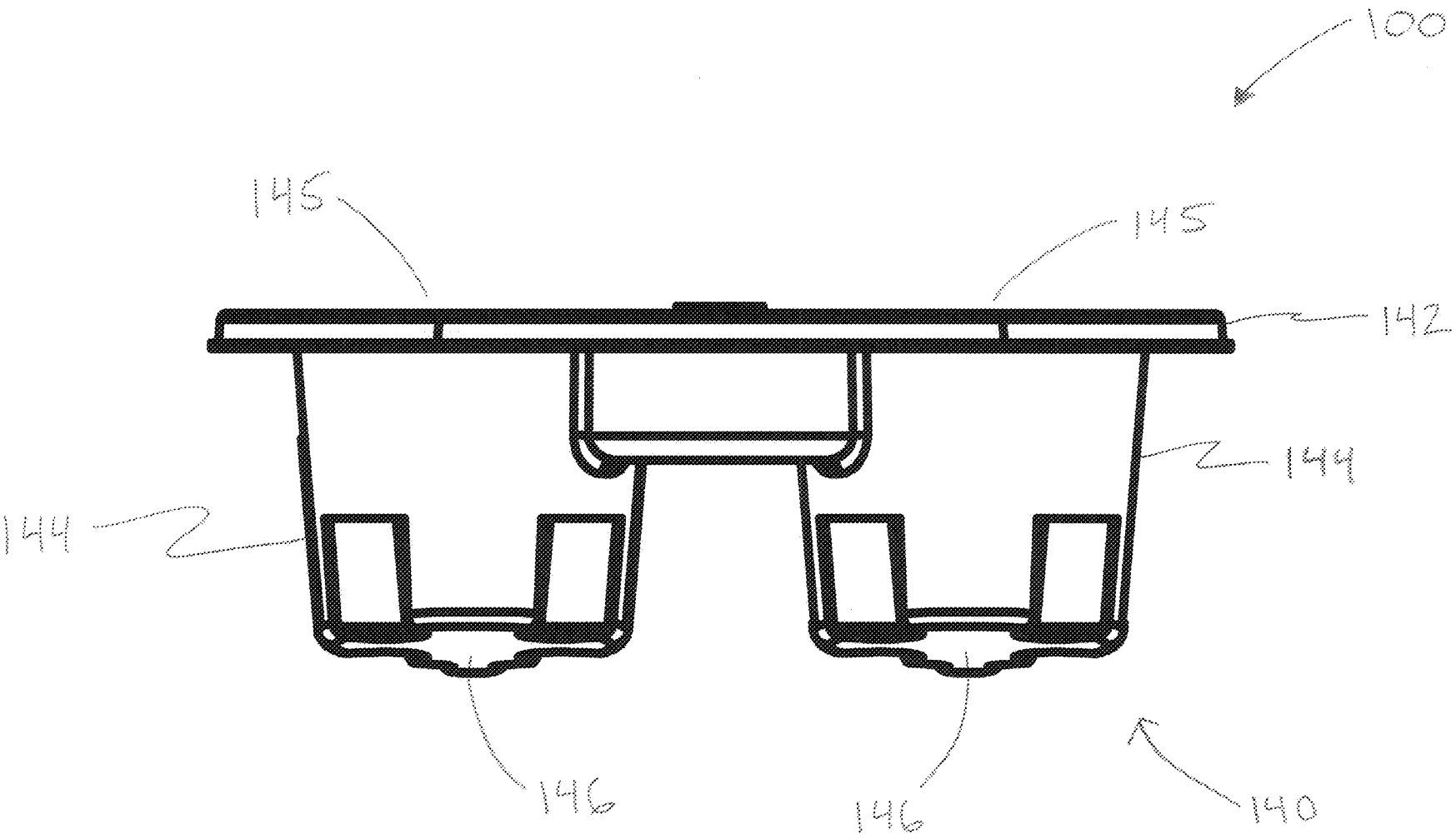
FIG. 8 is a front elevation of the mobile beverage holder assembly of the alternative illustrative embodiment of FIG. 1.

With continued reference to the alternative illustrative embodiment of the mobile beverage holder assembly 100 of FIG. 7, a mounting unit 120 in accordance with the present invention comprises a mounting member 122 having a mounting aperture 124 formed there through. More in particular, and as before, a mounting member 122 comprises a mounting aperture 124 formed there through wherein the mounting aperture 124 has a length and width dimensioned for mounting over a handle of a piece of luggage, such as is shown with reference to mobile beverage holder assembly 10 in in the illustrative embodiments of FIGS. 5 and 6. A mounting member 122 in accordance with at least one embodiment of the present invention comprises geometric configuration so as to provide structural support to the mounting unit 120. It will be appreciated by those of skill in the art that the geometric configuration may comprise any of a number of geometric configurations including, but not limited to square, rectangular, curvilinear, triangular, trapezoidal, polygonal, etc. In at least one embodiment, a mounting member 122 in accordance with the present invention comprises a geometric configuration having a curvilinear configuration around its outer periphery, as well as around the periphery of the mounting aperture 124, such as is shown best in the alternative illustrative embodiments of FIGS. 7 and 10.

As also stated above, in at least one embodiment, a mobile beverage holder assembly 100 in accordance with at least one alternative embodiment of the present invention includes a beverage holder unit 140 directly interconnected to a mounting unit 120. In at least one further embodiment, a beverage holder unit 140 is directly interconnected to a mounting unit 120 via a mounting unit interface 128. As shown best in the alternative illustrative embodiments of FIGS. 7 and 10, a mounting unit interface 128 extends substantially along the interface between a mounting unit 120 and a beverage holder unit 140. In at least one further embodiment, a mounting unit interface 128 comprises a substantially rigid material of construction directly interconnecting a beverage holder unit 140 to a mounting unit 120.

A beverage holder unit 140 in accordance with the present invention is dimensioned to receive and support at least one beverage container in an upright and operative orientation. More in particular, as discussed in greater detail below, a beverage holder unit 140 in accordance with at least one embodiment of the present invention comprises at least one beverage holder 144 which is dimensioned to receive at least a lower portion of a beverage container therein.

Figure 9:
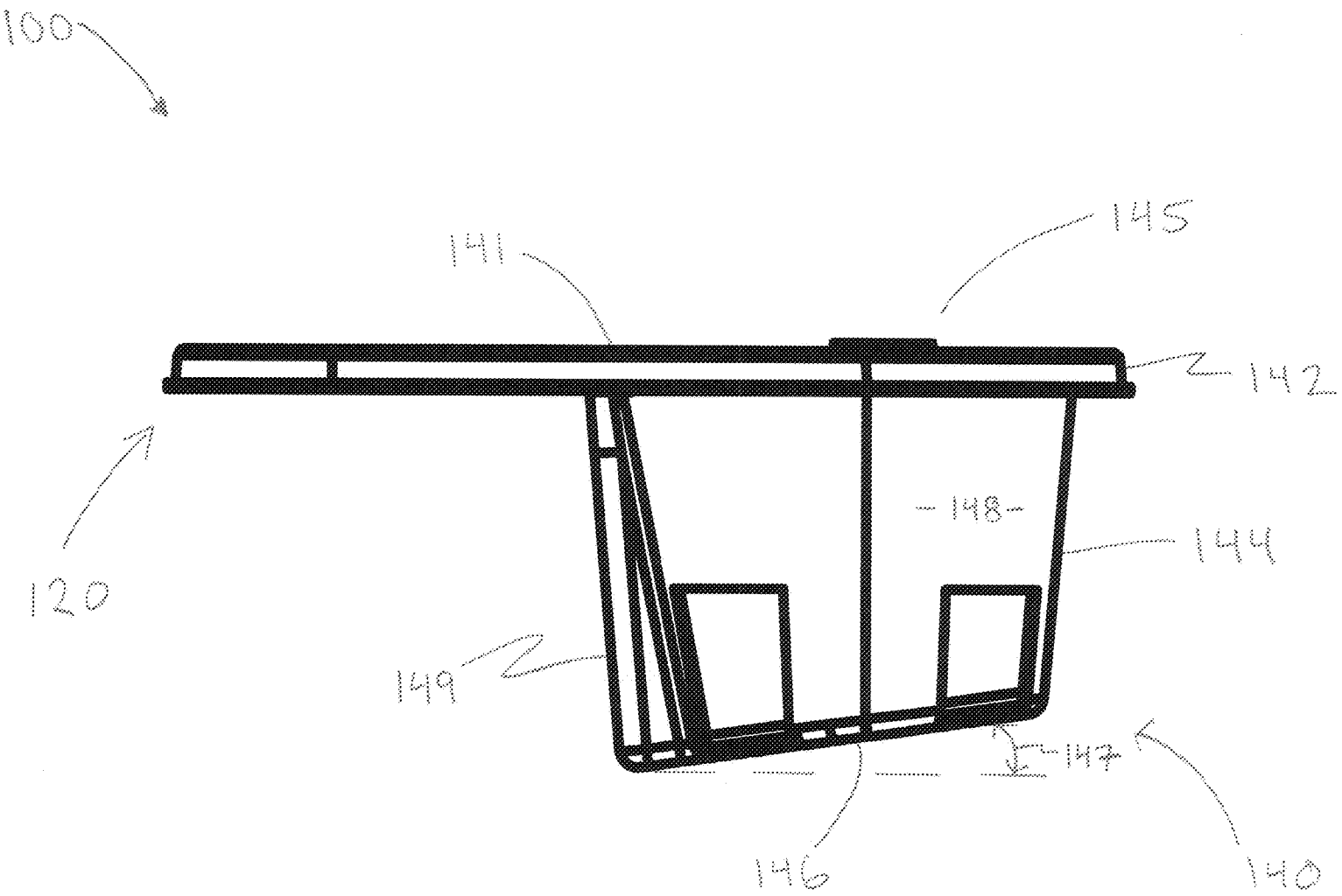
FIG. 9 is a side elevation of the mobile beverage holder assembly of the alternative illustrative embodiment of FIG. 1.
Figure 10:
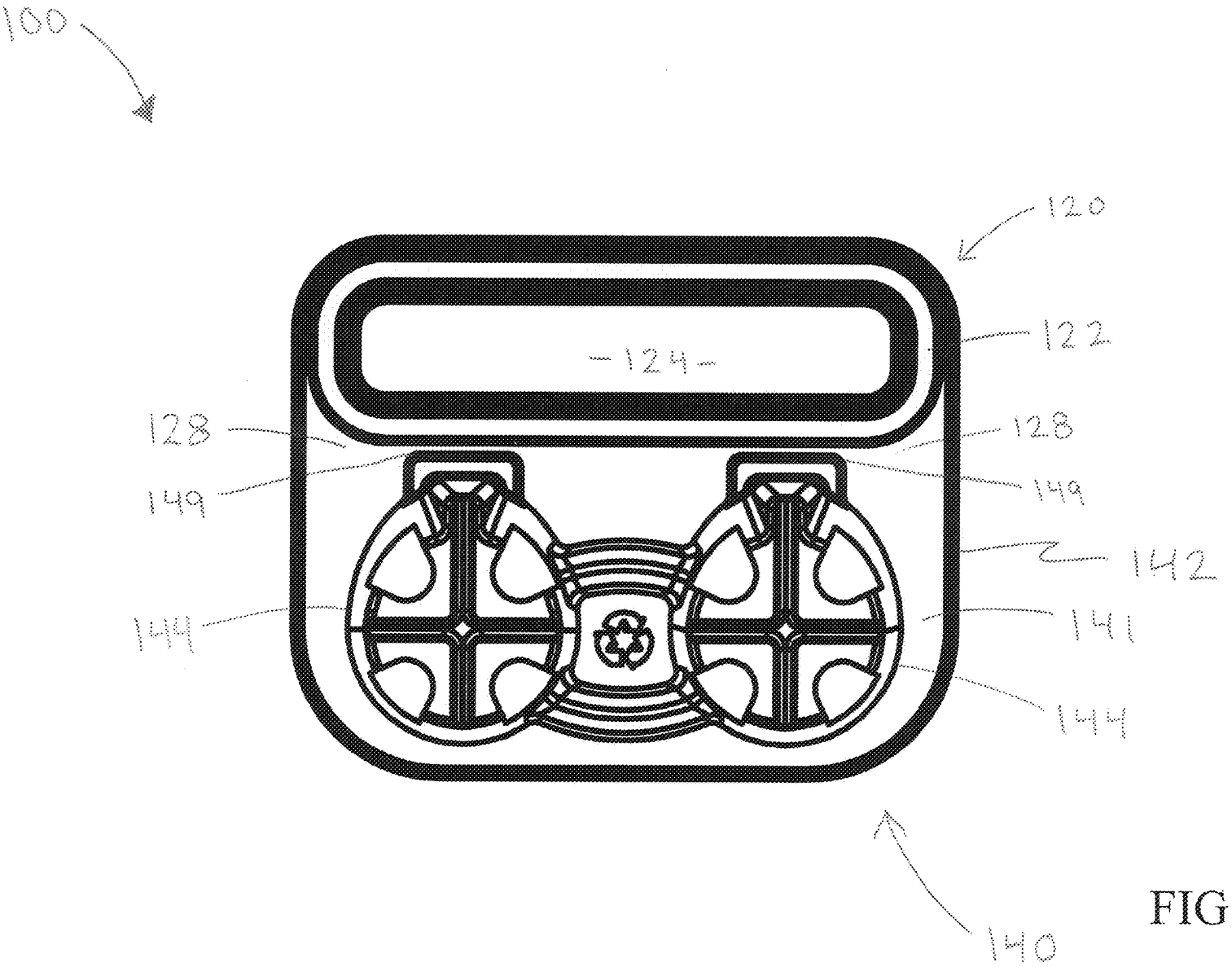
FIG. 10 is a top plan view of the mobile beverage holder assembly of the alternative illustrative embodiment of FIG. 1.

Turning once again to the alternative illustrative embodiment of FIGS. 7 and 10, a beverage holder unit 140 in accordance with the present invention comprises a platform member 141. In at least one embodiment, a platform member 141 of a beverage holder unit 140 is at least partially defined by an outer periphery 142. Similar to the mounting member 122 of the mounting unit 120, in at least one embodiment, an outer periphery 142 of a beverage unit holder 140 comprises a geometric configuration so as to provide additional structural support to a platform member 141. As before, it will be appreciated by those of skill in the art that the geometric configuration may comprise any of a number of geometric configurations including, but not limited to square, rectangular, curvilinear, triangular, trapezoidal, polygonal, etc. In at least one embodiment, an outer periphery 142 of a beverage unit holder 140 in accordance with the present invention comprises a geometric configuration having a curvilinear configuration, such as is shown best in the alternative illustrative embodiment of FIGS. 7 through 9.

As stated above, a beverage holder unit 140 in accordance with the present invention comprises at least one beverage holder 144. Looking in particular to the alternative illustrative embodiments of FIGS. 7, 8 and 10, a beverage holder unit 140 in accordance with at least one embodiment of the present invention comprises a plurality of beverage holders 144.

A beverage holder 144 includes an access opening 145 through which a lower portion of a beverage container may be inserted into the beverage holder 144. With reference to the alternative illustrative embodiments of FIGS. 8 and 9, a beverage holder 144 further comprises a base 146 disposed opposite an access opening 145. More in particular, a base 146 of a beverage holder 144 is dimensioned and disposed to support a beverage container within a beverage holder 144.

In at least one embodiment, a base 146 of a beverage holder 144 in accordance with the present invention is disposed at an upwardly extending release angle 147. More in particular, a base 146 of a beverage holder 144 is disposed at an upwardly extending release angle 147 so as to facilitate nesting during manufacture and shipment of the mobile beverage holder assemblies 100 in accordance with the present invention, as well as subsequent release of an individual mobile beverage holder assembly 100 from a nested configuration. In accordance with one embodiment of the present invention, a release angle 147 may be about one degree to about thirty degrees, and in at least one further embodiment, a release angle 147 may be about five degrees to about fifteen degrees. As shown in the alternative illustrative embodiment of FIG. 9, a release angle 147 is about eight degrees.

A beverage holder 144 in accordance with at least one embodiment of the present invention further comprises at least one sidewall 148 which interconnects a base 146 with a platform member 141 of a beverage holder unit 140. As shown best in the alternative illustrative embodiment of FIG. 7, a beverage holder 144 in accordance with one further embodiment of the present invention includes a plurality of sidewalls 148 interconnecting the base 146 with a platform member 141 of the beverage holder unit 140.

Looking next with reference to the alternative illustrative embodiments of FIGS. 9 and 10, a beverage holder 144 of a beverage holder unit 140 in accordance with the present invention comprises a support member 149. As shown best in the alternative illustrative embodiment of FIG. 9, a support member 149 comprises a back wall which is disposed in a vertical orientation and is positioned so as to be approximately perpendicular to a platform member 141 of beverage holder unit 140. Therefore, a support member 149 serves to maintain a beverage holder 144 in a substantially upright and operative orientation when a mobile beverage holder assembly 100 in accordance with the present invention is disposed in an operative position over a handle of a piece of luggage.

More importantly, a support member 149 serves to maintain a beverage holder 144 in a substantially upright orientation such that the beverage holder 144 can receive and support a beverage container in an upright and operative orientation when a mobile beverage holder assembly 100 in accordance with the present invention is disposed in an operative position over a handle of a piece of luggage.

In accordance with at least one embodiment of the present invention, a mounting unit 120 of a mobile beverage holder assembly 100 is dimensioned to fit within a seat back pocket such as are commonly found in commercial airlines, commuter trains, automobiles, etc. As such, it will be appreciated by those of skill in the art that the present mobile beverage holder assembly 100 may be utilized to receive and support one or more beverage containers in upright and operative orientation while a user is traveling in a commercial airliner, commuter train, automobile, etc.

In one embodiment of the present invention, a mounting unit 120 and a beverage holder unit 140 are independently formed and thereafter interconnected via a mounting unit interface 128. Alternatively, a mounting unit 120 and a beverage holder unit 140 of a mobile beverage holder assembly 100 in accordance with the present invention comprise a unitary construction with a mounting unit interface 128.

As will further be appreciated by those of skill in the art a mobile beverage holder assembly 100 in accordance with the present invention may be constructed from any of a wide variety of materials including, but not limited to, cardboard, plastic, metal or metal alloys, fiberglass, etc. In one further embodiment, a mobile beverage holder assembly 100 in accordance with the present invention may be constructed from any of a variety of natural materials which are readily biodegradable including, but in no manner limited to, wheat straw, potato starch, corn starch, bagasse, bamboo and/or bamboo fibers, hemp and/or hemp fibers, etc. In at least one embodiment, a mobile average holder assembly 100 in accordance with the present invention may be constructed from any of a variety of recycled materials. In yet one further embodiment, a mobile beverage holder assembly 100 in accordance with the present invention is constructed of molded pulp, such as is commonly utilized in preparing disposable beverage and/or food carriers.

Since many modifications, variations and changes in detail can be made to the described embodiment of the invention, it is intended that all matters in the foregoing description and shown in the accompanying drawings be interpreted as illustrative and not in a limiting sense. Thus, the scope of the invention should be determined by the appended claims and their legal equivalents.

What is claimed is:

1. A mobile beverage holder assembly for use with a piece of luggage to support at least one beverage container, said assembly comprising:

a piece of luggage with a handle configured to extend from a top surface of the piece of luggage and with a front surface and a rear surface opposing the front surface of the piece of luggage;

a mounting unit comprising a mounting member having a mounting aperture there through, said mounting aperture having the handle of the piece of luggage disposed therein and with the mounting unit mounted over the top surface of the piece of luggage;

at first adjustment tab removably connected within and to one end of a periphery of said mounting aperture and a second adjustment tab removably connected within and to an opposite end of the periphery of said mounting aperture, said first and second adjustment tabs separated at the opposite ends of said mounting aperture without any adjustment tabs disposed between the first and second adjustment tabs and when first and second adjustment tabs are removed from said periphery of said mounting aperture said mounting aperture is increased in length to accommodate the handle of the piece of luggage;

a beverage holder unit interconnected to said mounting unit, extending outwardly in a direction from the rear surface of the piece of luggage, and dimensioned to receive and support the at least one beverage container in an upright orientation;

a mounting unit interface, comprising a living hinge, disposed in interconnecting relation between a suspension unit and the mounting unit;

a suspension unit interface, comprising a living hinge, disposed in interconnecting relation between the suspension unit and the beverage holder unit and said suspension unit; and said mounting unit and said beverage holder unit comprising a unitary construction.

2. The assembly as recited in claim 1 wherein said mounting unit and said beverage holder unit comprise molded pulp.

3. The assembly as recited in claim 1 wherein said mounting unit is further dimensioned for mounting into a seat back pocket.

4. The assembly as recited in claim 1 further comprising said mounting unit, said mounting unit interface, said suspension unit, said suspension unit interface and said beverage holder unit comprising a unitary construction.

5. A mobile beverage holder assembly for use with a piece of luggage to support at least one beverage container, said assembly comprising:

a piece of luggage with a handle configured to extend from a top surface of the piece of luggage and with a front surface and a rear surface opposing the front surface of the piece of luggage;

a mounting unit comprising a mounting member having a wall defining a mounting aperture extending there through and having the handle of the piece of luggage disposed in the mounting aperture and with the mounting unit mounted over the top surface of the piece of luggage;

a beverage holder unit interconnected to said mounting unit, said beverage holder unit with an upper wall defining an access opening, extending outwardly in a direction from the rear surface of the piece of luggage, and dimensioned to receive and support the at least one beverage container in an upright orientation, the beverage holder unit having a sidewall extending downwardly from the upper wall of the beverage holder and having a base directly coupled to the sidewall;

a mounting unit interface, comprising a living hinge, disposed in interconnecting relation between a suspension unit and said mounting unit;

a suspension unit interface, comprising a living hinge, disposed in interconnecting relation between said beverage holder unit and said suspension unit and extending downwardly from the top surface of the piece of luggage and adjacent to the rear surface of the piece of luggage; and said mounting unit, said mounting unit interface, said suspension unit, said suspension unit interface and said beverage holder unit comprising a unitary construction.

6. The assembly as recited in claim 5 wherein said beverage holder unit comprises at least one beverage holder, said beverage holder dimensioned to receive a lower portion of the at least one beverage container therein.

7. The assembly as recited in claim 5 wherein said beverage holder unit is dimensioned to simultaneously receive and support a plurality of beverage containers in an upright orientation.

8. The assembly as recited in claim 7 wherein said beverage holder unit comprises a plurality of beverage holders, each of said plurality of beverage holders dimensioned to receive a lower portion of a corresponding one of the plurality of beverage containers therein.

9. The assembly as recited in claim 8 wherein each of said plurality of beverage holders comprises a support member disposed to maintain a corresponding one of said plurality of beverage holders in a substantially upright and operative orientation when said assembly is mounted over the handle of the piece of luggage.

* * * * *